US006471835B1

(12) United States Patent
Sjöberg et al.

(10) Patent No.: US 6,471,835 B1
(45) Date of Patent: Oct. 29, 2002

(54) CLAMPING DEVICE FOR ELECTROCHEMICAL CELL

(75) Inventors: Maria Sjöberg, Motala; Anders Ullman, Ljungaverk; Karl Axel Hugosson, Ånge; Mikael Tenfält, Karlstad; Martin Kroon, Sundsvall, all of (SE); Jostein Per Saetre, Kristiansand; Tor Haakon Groesle, Lillesand, both of (NO)

(73) Assignee: Permascand AB, Ljungaverk (SE)

( * ) Notice: Subject to any disclaimer, the term of this patent is extended or adjusted under 35 U.S.C. 154(b) by 0 days.

(21) Appl. No.: 09/623,229

(22) PCT Filed: Mar. 1, 1999

(86) PCT No.: PCT/SE99/00287

§ 371 (c)(1),
(2), (4) Date: Oct. 17, 2000

(87) PCT Pub. No.: WO99/45174

PCT Pub. Date: Sep. 10, 1999

(30) Foreign Application Priority Data

Mar. 5, 1998 (SE) ..... 9800698

(51) Int. Cl.[7] ..... B23H 3/04

(52) U.S. Cl. ..... 204/286.1; 204/280; 204/283; 204/284; 204/288; 204/288.2; 204/288.3; 204/288.4; 204/288.5; 204/289

(58) Field of Search ..... 204/286.1, 280, 204/283, 284, 288, 288.2, 288.3, 288.4, 288.5, 289

(56) References Cited

U.S. PATENT DOCUMENTS

| | | | | |
|---|---|---|---|---|
| 3,674,676 A | * | 7/1972 | Fogelman | 204/286.1 |
| 3,895,210 A | | 7/1975 | Olson | 219/80 |
| 3,940,328 A | | 2/1976 | Thomas | 204/283 |
| 4,154,667 A | * | 5/1979 | Pohto et al. | 204/286.1 |
| 4,448,664 A | * | 5/1984 | Ikegami et al. | 204/286.1 |
| 4,855,032 A | | 8/1989 | Fabian | 204/286 |
| 5,100,525 A | * | 3/1992 | Pohto et al. | 204/286.1 |
| 5,993,620 A | * | 11/1999 | Meneghini et al. | 204/286.1 |

* cited by examiner

*Primary Examiner*—Bruce F. Bell
(74) *Attorney, Agent, or Firm*—David J. Serbin

(57) ABSTRACT

The invention relates to an electrode assemblage clamping device for an electrode comprising two parallel, essentially flat and rectangular electrode members, and at least one current supply rod/conductor bar, arranged between and in conductive contact with said electrode members. The device comprises a clamping means provided along at least a part of the vertical peripheral edges of said electrode elements, said clamping means comprising a resilient member and an abutment member. The latter are configured such that each electrode member is clamped between one respective part each of the abutment member and of the resilient member.

15 Claims, 4 Drawing Sheets

Fig. 1
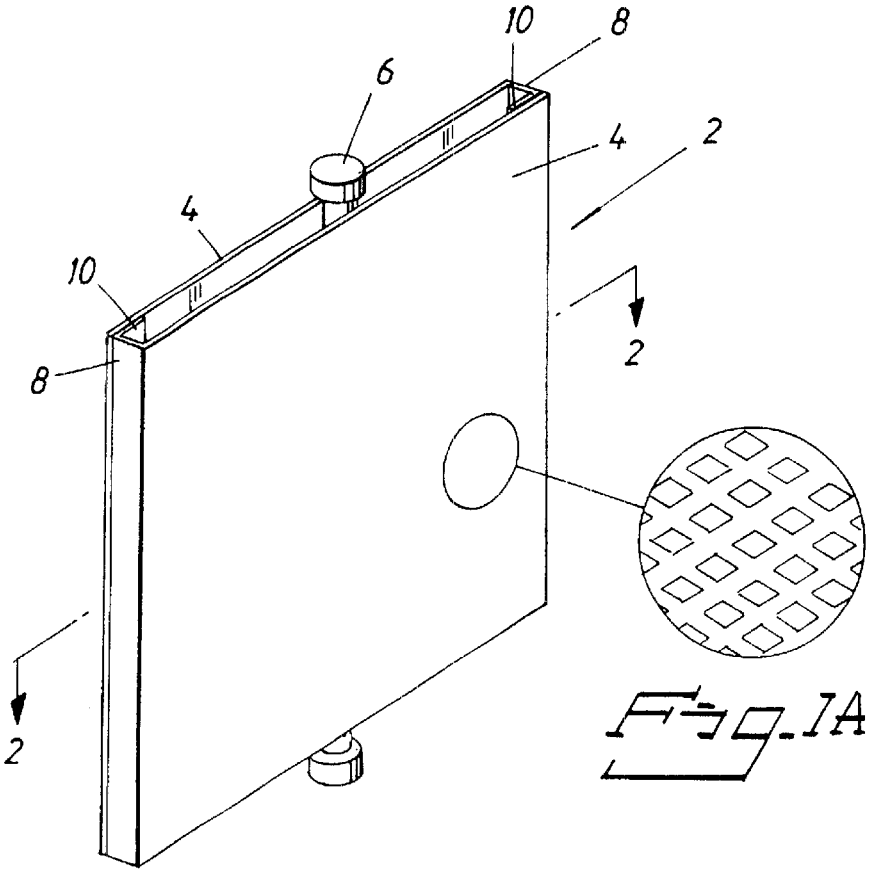
Fig. 1A
Fig. 2
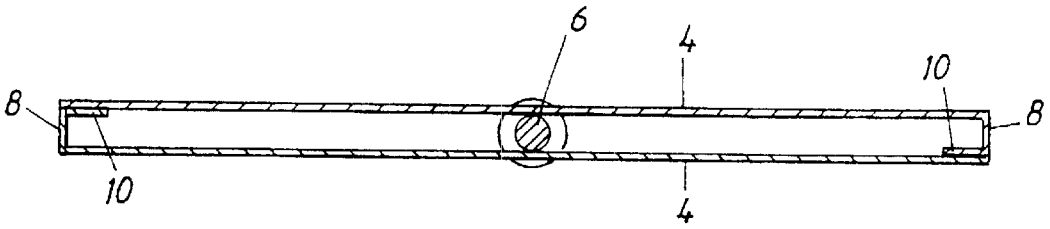

A–A

B–B

CLAMPING DEVICE FOR ELECTROCHEMICAL CELL

The present invention relates generally to electrochemical cells, especially such cells for wet recovery of metals, so called electrowinning, and cells for chlorine production. In particular it is directed to a clamping device for electrodes of such cells for improved assemblage thereof.

It also relates to an electrode and to an electrochemical cell incorporating such device.

BACKGROUND OF THE INVENTION

The present invention relates to the technical field of electrochemical processing in general:

However, the present invention is most suitable for electrowinning and certain aspects of chlorine production.

Electrowinning processes are most often of the sulphate or chloride type. The present invention is relevant to both types of process.

Chlorine production processes are of the diaphragm type, the Hg type, or the membrane type. The present invention is relevant to the diaphragm or membrane type of process.

For electrowinning purposes the metal of interest is deposited on the cathode in an electrochemical process, whereby a starter plate or sheet of the metal is used as the cathode. For the anodes various types have been used in the past. Thus, lead (Pb) anodes have been commonly used. The Pb anodes have the shape of a parallelepiped into which a current distributor rail has been moulded, and which is located in parallel with the short sides, thereby acting as a yoke. The yoke rests against current supply rods in the electrolysis vessel. These anodes, when new, exhibit a reasonably good current distribution. but since Pb is consumed in the process there are defined problems and disadvantages, both from an environmental viewpoint, and from a technological. Thus, Pb being a toxic heavy metal renders the waste from the process hazardous and difficult and cumbersome to dispose of. This is especially the case in view of the regulations regarding handling of heavy metals as waste becoming more and more restrictive.

From a technological point of view, the Pb consumption increases the distance between the anode and the cathode, which leads to higher energy consumption and uneven current distribution, and thus to anomalous or erratic deposition of the metal on the cathode, so called dendrites. These electrodes are referred to as consumable electrodes.

Another point of consideration is that the acceptance level of residual Pb in the metal that is produced on the cathode by electrowinning has decreased over the last decades.

Recasting of used Pb anodes is also a controversial activity from an environmental point of view, and will become increasingly restricted.

Titanium anodes for electrowinning, having a grid structure were developed in the 70's adapted for the cost of electrical energy prevailing at the time. Such grid anodes are composed of parallel wires, where the wire-wire distance is substantially larger than the diameter of the wires. This has the effect of creating an unfavourable current distribution if one attempts to bring anodes and cathodes closer to each other, in the strive for reduced energy consumption. The cathode quality decreases rapidly if a grid anode of this type is allowed to operate in too close proximity of the cathode, namely by promoting development of dendrites of metal. These dendrites may short-circuit the grid, and may even cause physical obstructions leading to damages when anodes are removed from the bath.

Thus, it would be advantageous to have electrodes on which do not promote dendrite formation. A solution to this is to use so called box electrodes.

Such box electrodes in the form of anodes, which are a type of so called dimensionally stable anodes for electrolysis cells (referred to as "box anodes" for reasons set forth below) are well known in the art of electrochemical engineering. See e.g. the patents SE-7407606-8 (Diamond Shamrock Corp.), relating to the basic design of such anodes. and U.S. Pat. No. 3,940,328 (Electronor Corp.) relating to reconstruction of anodes.

In SE-7407606-8 there is disclosed a dimensionally stable anode for use in an electrolysis cell. It comprises a generally cylindrical conductor bar and a pair of metal plates, provided essentially on diametrically opposed sides of said holder. The metal plates are essentially plane parallel and one respective edge portion of each plate is bent to provide a continuous surface, thereby forming a box like structure; hence the designation "box anode".

However, these box anodes are more expensive than the grid electrodes, and those available today are also difficult to repair because they are assembled by welding. In the repair process often welds have to be broken up, which is very tedious and often lead to substantial scrapping of anodes, further increasing the total cost.

In certain cases the electrochemical separation is carried out with the anode separated from the cathode by enclosing it in a bag of a conventional design. Such bags are soft and flexible, which is required for achieving adequate sealing. The useful life of such a bag is relatively short, and it would be desirable to have access to electrode enclosures with longer useful life. Primarily the resistance against corrosion should be improved. Use of stiffer or harder membranes and diaphragms results in prolonged lifetime, but would require other electrode designs.

From a production point of view, conventional box anodes mostly are manufactured of mesh metal, the surface of which has been levelled out in a rolling operation. Welding and bending operations will become facilitated thereby. However, such conventional box anodes have been developed to function without any enclosures. If such an anode is provided with a membrane or a diaphragm in very close proximity to the anode surface, mass transport will be remarkably deteriorated. Namely, the bubbles forming on the mesh structure will not result in the required circulation. In the preferred design the expanded metal has not been leveled out, which results in the diaphragm/membrane being disposed in close proximity to a very small portion of the total surface. Obviously, these two requirements are contradictory.

Another disadvantage caused by the use of welding as a means of assembling the electrodes, is that there will inevitably be residual stress remaining in the box structure after manufacture. Such residual stresses will have adverse effects of various kinds. The shape of the box may be slightly altered such that it deviates from its rectilinear box shape.

Furthermore, used up anode bags of all kinds present a waste disposal problem in that the material is frequently heavily contaminated with undesirable residual material from the electrolytic processes.

Certain electrochemical processes are operated at high temperature and low pH (<1), and for such conditions the presently available box anodes are vulnerable.

SUMMARY OF THE INVENTION

Thus, the present invention seeks to provide means for obtaining an anode structure for electrochemical cells wherein the drawbacks of prior art have been overcome.

In accordance with the invention this object is achieved by refraining from welding the edges of the box anode. Instead the box structure is arrived at by providing a clamping device as claimed in claim 1, an electrode as claimed in claim 7, and an electrochemical cell as claimed in claim 15.

The clamping device of the invention comprises a resilient member cooperating with an abutment member, such that two parallel, essentially flat and rectangular electrode members of an anode assembly, are clamped between one part each of the abutment member and a corresponding part of the resilient member, whereby the clamping means forms a spacer keeping the electrode members in a spaced apart relationship.

The clamping device according to the invention therefore provides for assembly of an electrode of the box anode type without the need of welding, thus reducing or even eliminating residual stress. Disassembly, if necessary, is very easy since there are no welds that need to be broken up. This also has the beneficial effect that the active coating on the anode will not be damaged by the forceful operation needed for breaking up welds.

Preferably the device according to the invention is made of titanium.

BRIEF DESCRIPTION OF THE DRAWINGS

The invention will now be described by way example and with reference to the accompanying drawings in which:

FIG. 1 is a perspective view of a prior art box anode;

FIG. 1A is a detail of the mesh structure of the anode;

FIG. 2 is a cross section of the box anode of FIG. 1 taken at 2—2;

DETAILED DESCRIPTION OF PREFERRED EMBODIMENTS

Figure 3:
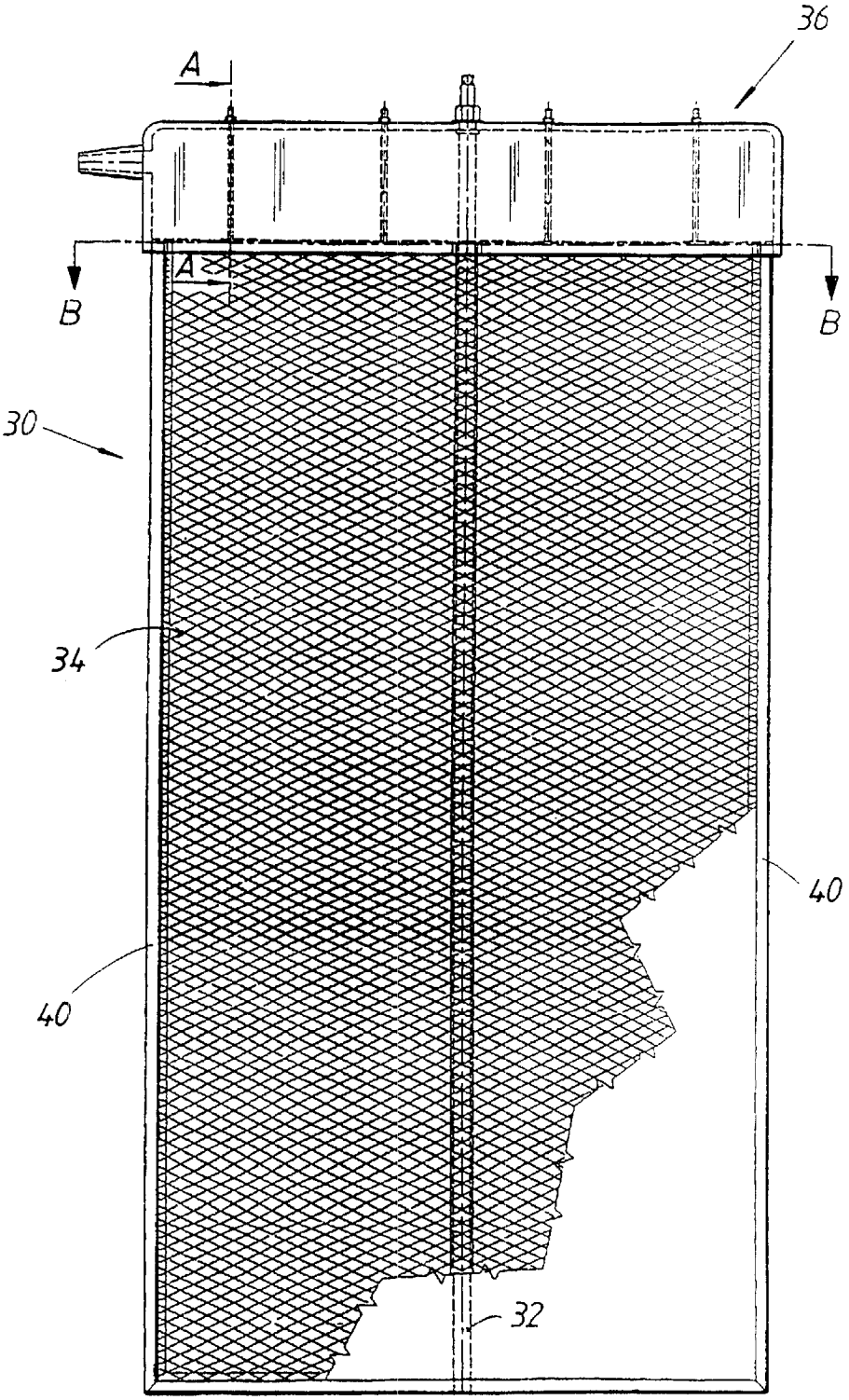
FIG. 3 is a front view of an embodiment of a box anode incorporating the present invention.

In the figures symmetrical elements have been given the same reference numerals.

It should be pointed out that although the invention is described in terms of an anode, the principles underlying the invention is also applicable to cathodes.

With reference now to FIGS. 1 and 2 there is shown a conventional prior art box anode (according to SE-7407606-8) generally designated 2. It comprises two essentially plane and parallel metal sheets 4. The sheets 4 are attached on diametrically opposed sides of a generally cylindrical anode support and current supply rod 6. The box-like structure is provided by folding one edge of each metal sheet 4, first by 90° to form a respective edge portion 8 at right angles, and then by folding a part of said edge portion a further 90° to form a respective fastening ledge 10 for each metal sheet 4. The ledge 10 of one metal sheet 4 is attached by welding to the other metal sheet 4 at that edge thereof opposite to the edge where its ledge 10 is provided. Spot welding is preferred.

The metal sheet is preferably mesh metal or expanded metal.

In FIG. 3 there is shown an embodiment of a novel box anode comprising the inventive features.

Instead of folding and welding the metal sheets to each other, as in the prior art device shown in FIG. 1, there is provided an inventive clamping device, various embodiments of which will be described in detail below.

The box anode generally designated 30 in FIG. 3, comprises a bimetallic current supply rod 32, comprising a core of a metal with high conductivity, e.g. Cu or Al, and an envelope or jacket made of a corrosion resistant metal, e.g. Ti or an alloy of Ti. The rod 32 is made by coextrusion, either to a solid rod or a thick walled tube, by methods known per se. Another designation of such a current supply rod is "clad bar".

The box anode 30 further comprises two electrode sheets 34 in the form of a mesh or other foraminous structure. Preferably such structure is made of expanded metal, conventionally by forming slits in a solid metal sheet and stretching the sheet to form diamond shaped apertures. Other types of foraminous structures are conceivable, such as perforated metal and foam metal.

In its simplest embodiment the apertures of the grid may be relatively large, but still allowing for adequate current supply and current distribution over the entire surface. In a preferred embodiment the electrodes are made of Ti with a catalytic coating applied to the surface. However, other materials are conceivable, in particular for cathodes where materials such as steel and Ni are possible alternatives. In electrowinning of course the cathode is made of the material to be recovered.

In cases where the demands on the current distribution are stricter, a second mesh with smaller apertures may be provided by welding onto the coarser mesh, which will then act as the current distributor. The catalytic coating will be provided on the outer finer mesh. This is conventional and does not form part of the invention per se.

The electrode sheets 34 are welded onto the current supply rod 32 on diametrically opposed sides of the rod, whereby the sheets become plane parallel. Preferably the sheets 34 are welded such that the current supply rod 32 extends vertically and essentially in the center of the sheets, for achieving optimal current distribution. For attaching the electrode sheets to the rod 32, spot welding or laser welding may be used.

On top of the electrode assembly there is provided a gas collecting and protective hood 36, to be described below.

In order to complete the box-like structure, a clamping device 40 is utilized to form a peripheral frame around the edges of the electrode sheets. Embodiments of this clamping device will now be described in detail with reference to FIG. 4.

Thus, in a first embodiment the clamping device 40 comprises a frame member 41 in the form of an elongated profile having a generally "U"-shaped cross section, and comprising legs 43 and a web 46. Electrode sheets 44 are placed inside the frame member 41 such that the edges 44*a* are in contact with the inner side of a respective leg 43. In practically all operating cases it will be necessary to provide some kind of enclosure of the anode compartment, as discussed in the preamble. Thus, there is provided a diaphragm 42 on the outer side of each electrode sheet 44, interposed between said edges 44*a* and said legs 43.

In order to keep the assembly of electrode sheets 44 and membranes or diaphragms 42 firmly in place within the frame 41, there is provided a resilient member in the form of a clamping ledge 45 between the electrode sheets 44. This clamping ledge 45 comprises two legs 47, and a web portion 48. The ledge 45 is designed to have a certain degree of resilience, which is achieved by bending the web portion 48 as illustrated. Thus the ledge 45 has a cross section generally resembling an "M" wherein the edges are rounded. The web portion 48 has a wave like shaped cross section, and there are certain geometrical restrictions on the dimensions of this wave shape in order that the ledge obtain the optimal function. The calculations required to arrive at a suitable profile is well within the competence of a person of ordinary skill in the art of metal construction, and will not be further detailed herein. Some routine experimentation may be required, and each individual application of the inventive concept will require calculation of a new profile.

The frame member 41 thus acts as an abutment member on which the resilient member presses in order to clamp the diaphragm and electrode sheets in place.

Figure 4:
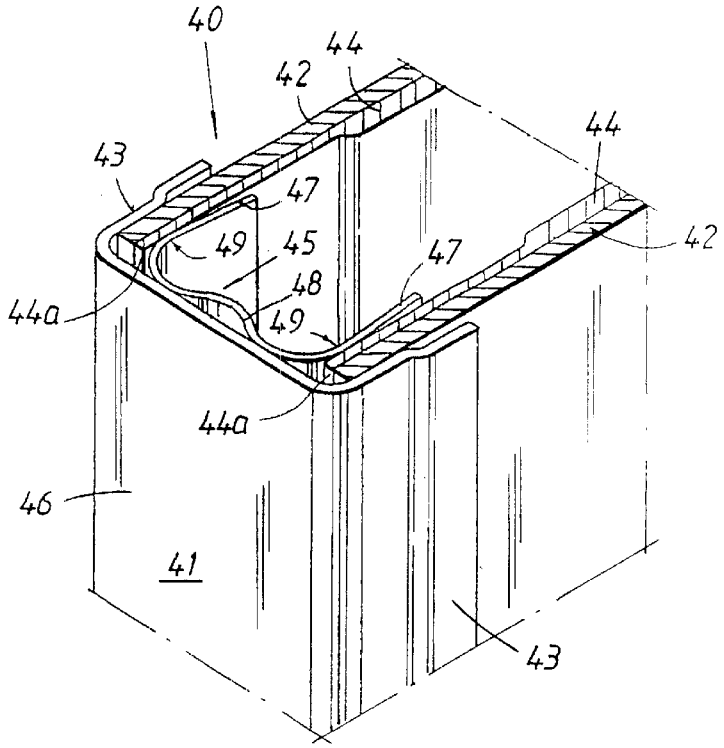
FIG. 4 is a perspective view of an electrode incorporating a first embodiment of the clamping device according to the invention.

In particular it should be noted that in its mounted position, the clamping ledge exerts a force against the inner side of the frame member 41 only along a line (or if only the cross section is considered, at a single point) at 49 in FIG. 4. Thus, in its mounted position the legs 47 of the ledge 45 points slightly inwards, i.e. the distance between the legs at their edges is slightly less than the distance between the points of contact 49. This means of course that the nominal distance, i.e. in a non-tensioned state, between the contact points is slightly larger than the same distance when the ledge is mounted.

Since it is important that the diaphragms 42 seal off the anode compartment inside the electrodes 44 from the rest of the environment in an electrolysis cell, it is necessary to level out the surface of the mesh of the electrodes, along the edges 44*a*. Otherwise the diaphragm might be damaged in the contact with the relatively rough surface of the electrodes, or if the pressing force from the clamping ledge 45 is insufficient, there may be small channels between diaphragm and mesh where gas may escape, or where electrolyte may leak out inadvertently. This levelling out may be achieved by passing the electrode sheets through a simple rolling machine, or by a pressing operation.

The frame 41 preferably is made as an integral frame, covering all sides of the electrode assembly, except the top edge (thus having an overall configuration of a "U"). At the top a hood may be provided (to be described below). The clamping ledges 45 may be provided as separate elements for each vertical side and for the horizontal bottom edge. At the bottom it may be necessary to provide two ledges, because the clad bar extends down to the lower edge of the electrode sheets. In an alternative embodiment the clad bar may be provided such that it does not extend all the way down to the lower edge of the electrodes, but that might have negative effects on the current distribution. However, in the latter case the clamping ledge can be provided as an integral "U" shape.

Preferably the components of the clamping device are made of titanium, but it is conceivable to utilize polymer materials exhibiting the required combination of sufficient rigidity and flexibility, and which are resistant to chlorine. Examples of such materials are chlorinated and fluorinated polymers. Examples of such materials are Telen® (obtainable from Telenor, USA), Teflon® (obtainable from du Pont et Nemour, USA), and Kynar® (obtainable from Penwalt Corp., USA). Combinations of titanium and polymer materials are also conceivable.

Figure 5:
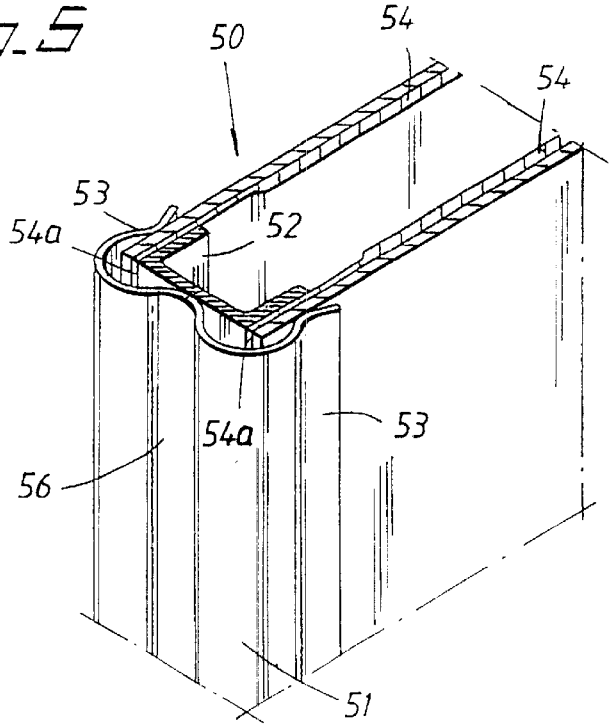
FIG. 5 is a perspective view of an electrode incorporating an alternative embodiment of the clamping device according to the invention.

In FIG. 5 there is shown an alternative embodiment of the clamping device, here designated 50, wherein the functionality of the constituent components is the opposite, compared to the embodiment of FIG. 4, but wherein the overall function remains the same.

Thus, instead of providing a frame member (designated 41 in FIG. 4) external of the electrodes, a rigid support member 52 is provided between the electrode sheets 54. The support member 52 is a rigid ledge or profile with a cross section generally in the shape of a "U".

The clamping member 51 according to this embodiment for providing the clamping force is thus provided externally of the electrodes, and has a similar configuration to that of the clamping ledge 45 of the embodiment in FIG. 4. It comprises a web 56 and two legs 53. In a non-assembled state the distance between the edges of the legs 53 must of course be shorter than the distance between electrode surfaces in assembled state, in order that the clamping be accomplished. For the same reason as above, the clamping force should be exerted along a line over the surface of the diaphragms, and therefore the legs must be slightly concave in relation to the surface on which it rests in assembled state.

The entire box anode may be sealed against the environment. This may be achieved by means of the detachable hood generally designated 36 in FIG. 3, mounted on top of the anode.

Figure 6:
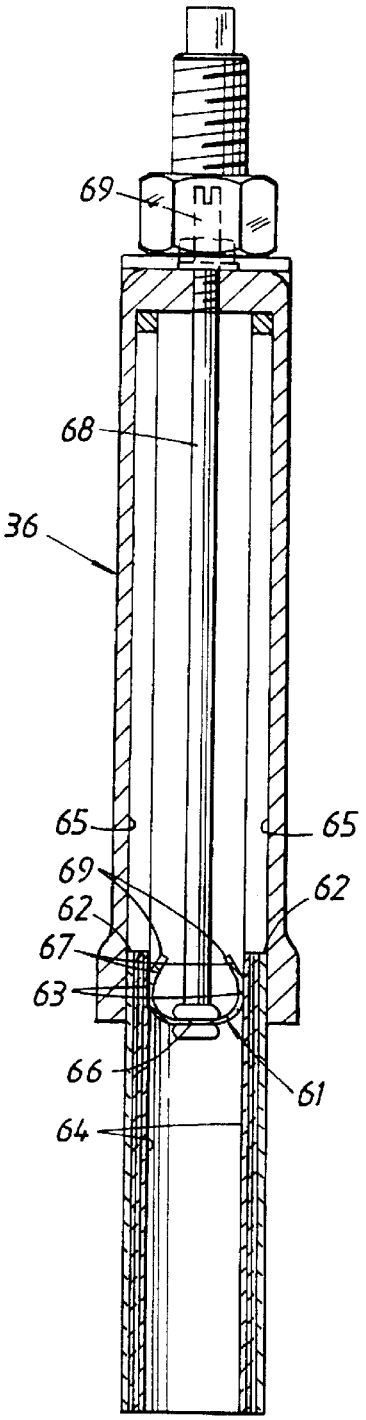
FIG. 6 is view in cross section of an electrode incorporating a protective hood, the section being taken through the hood at A—A in FIG. 3.
Figure 7:
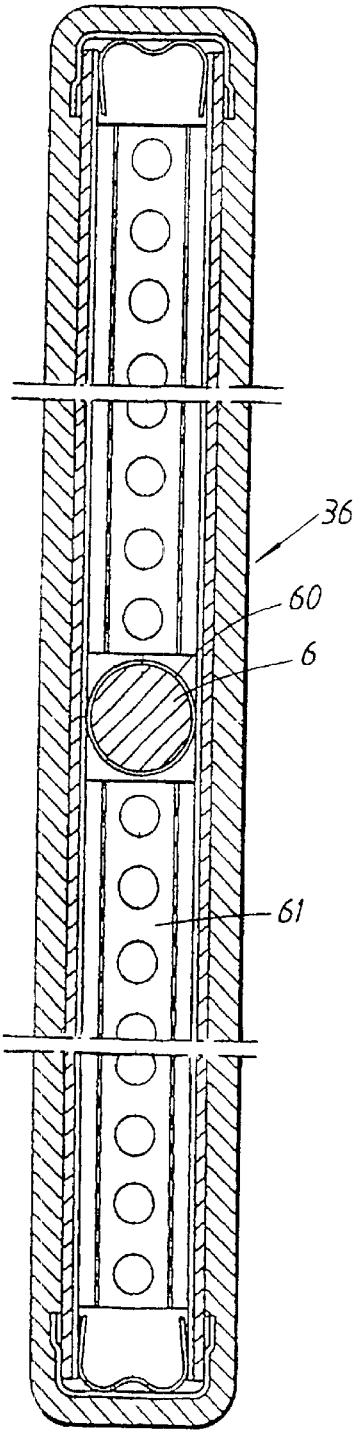
FIG. 7 is a cross section through the hood at B—B in FIG. 3.

In order to allow for the current supply rod or clad bar 6 to be passed through the hood 36 (shown in cross section in FIG. 6 along the line A—A in FIG. 3, and in FIG. 7 in cross section along the line B—B in FIG. 3), there is provided a through-hole 60 including a sealing in the top of the hood.

Since it is desirable that there be provided for a leakproof seal between the hood 36 and the upper edges 62 of the electrode elements 64, there is provided an internal hood spring 61 between the electrodes 64, pressing the electrodes against the respective inner walls 65 of the hood 36.

The hood spring 61 may have a design very similar to the clamping ledge 45 shown in FIG. 4, i.e. it comprises a web 66, possibly having a wave-like configuration, and two legs 67. The legs will have a distance between their outer contact surfaces 63 somewhat larger (by approximately 5–15%) than the nominal electrodes-to-electrode distance, for providing the necessary force to keep the hood in a sealing relationship with the electrode elements.

Because the current supply rod 6 is provided in the center of the electrode assembly, there will have to be provided two hood springs 61, one on each side of the rod 6. Preferably the end of the spring contacting the rod has a semi-circular recess in order to smoothly engage the circular surface of the rod.

Mounting the hood onto the anode assembly is performed as follows.

The hood is provided with at least two screws 68 (only one visible in FIG. 6), threaded in the top surface of the hood 36 and extending downwards. The heads 69 of the screws are accessible from above on the outside of the hood. The hood springs are attached to the lower end of the screws by suitable recesses or mounting means to render the screws freely rotatable, while still being kept attached to the springs.

The hood 36 is placed on top of an electrode assembly. Then the screws 68, 69 are turned and screwed home, whereby the hood springs 61 are lowered inside the hood 36. When the springs 61 reach the upper edges 62 of the electrode assembly, they are pressed in place, the contact surfaces 63 of the hood spring 61 thereby exerting the necessary force for obtaining an adequate sealing.

Since the box anode provides a closed environment, liquid inside the box will not penetrate to the outside. Thus, the contents of the box must be removed from the inner compartment when the box for some reason is removed from the process, e.g. for repair. To this end the frame is provided with holes in the bottom part.

In a preferred embodiment, the electrolysis vessel itself is provided with plug elements attached to the bottom of the vessel, and mating snugly with the holes in the box anode frames. Thus, when the box anode is lifted out of the vessel, the plugs immediately disengage and the liquid inside the box pours out during the lifting operation. For installation purposes it may be required to provide guide means such that the holes and plugs meet properly when the box anodes are placed in the vessel.

What is claimed is:

1. An electrode assemblage clamping device for an electrode, comprising two parallel, essentially flat and rectangular electrode members having vertical peripheral edges, at least one current supply rod/conductor bar arranged between and in conductive contact with said electrode members, and a clamp provided along at least a part of said vertical peripheral edges of said electrode members, said clamp comprising a resilient member and an abutment member configured such that each electrode member is clamped between one respective part each of the abutment member and of the resilient member.

2. The device as claimed in claim 1, wherein said abutment member comprises an elongated profile having a general cross section shape of a "U" and enclosing the peripheral edges of the electrode members and wherein the resilient member is provided inside the abutment and between the electrode elements, so as to exert a clamping force against the abutment and on the electrode member.

3. The device as claimed in claim 1, wherein said abutment member has a general shape of a "U" and is provided between the electrode members, and wherein the resilient member is provided over the abutment member and the electrode members, thereby exerting a pinching action on the electrode members, and clamping the electrode members between itself and the abutment, whereby the abutment member forms a spacer keeping the electrode members in a spaced apart relationship.

4. The device as claimed in claim 1, wherein the resilient member and the abutment member of said clamping device, comprise two complementary integral elements extending along the vertical and bottom edges of the electrode assembly leaving the top edge unsupported by said elements.

5. The device as claimed in claim 1, wherein the resilient member and the abutment member of said clamping device comprise two complementary members, one of which extending along the outer vertical and bottom edges of the electrode assemblage, the other comprising two elements each having an overall "L" shape, being provided between the electrodes on one side each of the central current supply rod.

6. The device as claimed in claim 1, comprising titanium.

7. The device as claimed in claim 1, comprising a chlorine resistant polymer, or of a combination of titanium and said polymer.

8. An electrode for electrochemical cells, said electrode comprising two parallel, essentially flat and rectangular electrode members, and at least one conductor bar, arranged between and in conductive contact with said electrode members, and a clamp comprising a resilient member and an abutment member configured such that each electrode member is clamped between one respective part each of the abutment member and of the resilient member.

9. The electrode as claimed in claim 8, comprising a detachable hood member mounted on the top end of the electrode assembly in a sealing relation to the top edges of the electrode members.

10. The electrode as claimed in claim 9, wherein the hood comprises a resilient locking member provided inside the hood, and connected to actuating means for pressing said locking member downwards and into a position between the electrodes such that it clamps the electrode members, and if present the membrane or diaphragm, between the inner walls of the hood and the locking member.

11. The electrode as claimed in claim 8, comprising an anode.

12. The electrode as claimed in claim 8, comprising a cathode.

13. The electrode as claimed in claim 8, comprising a membrane or diaphragm disposed over the surface of said electrode members, said membrane or diaphragm being clamped by said clamping means along the periphery of the electrode.

14. An electrochemical cell, comprising an electrolysis vessel, and a plurality of electrodes as claimed in claim 8.

15. The electrochemical cell as claimed in claim 14, wherein the bottom of the vessel is provided with protruding elements mating in corresponding holes in the bottom of the anodes, for providing plugs that are releasable when the anodes are lifted out of the vessel.

* * * * *